US010216126B2

(12) United States Patent
Obayashi

(10) Patent No.: US 10,216,126 B2
(45) Date of Patent: Feb. 26, 2019

(54) IMAGE FORMING APPARATUS WHICH DIVIDES IMAGE DATA INTO A PLURALITY OF REGIONS AND CONTROLS FIXING TEMPERATURE ACCORDINGLY

(71) Applicant: CANON KABUSHIKI KAISHA, Tokyo (JP)

(72) Inventor: Yosuke Obayashi, Nagareyama (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/684,730

(22) Filed: Aug. 23, 2017

(65) Prior Publication Data

US 2018/0067427 A1 Mar. 8, 2018

(30) Foreign Application Priority Data

Sep. 6, 2016 (JP) ..... 2016-173376

(51) Int. Cl.
*G03G 15/20* (2006.01)

(52) U.S. Cl.
CPC ..... *G03G 15/2039* (2013.01)

(58) Field of Classification Search
CPC ..... G03G 15/2039; G03G 15/2078
USPC ..... 399/69; 216/219
See application file for complete search history.

(56) References Cited

U.S. PATENT DOCUMENTS 8,983,327 B2 * 3/2015 Yabuuchi ..... G03G 15/2078 399/69
9,213,277 B2 * 12/2015 Goda ..... G03G 15/01
2012/0213540 A1 * 8/2012 Igarashi ..... G03G 15/2042 399/69
2016/0282777 A1 * 9/2016 Shibuya ..... G03G 15/2039
2018/0024476 A1 * 1/2018 Sato ..... G03G 15/2017

FOREIGN PATENT DOCUMENTS

JP 2009258448 A * 11/2009
JP 2014122932 A * 7/2014
JP 2015-55747 A 3/2015

* cited by examiner

*Primary Examiner* — Robert Beatty
(74) *Attorney, Agent, or Firm* — Canon U.S.A., Inc. IP Division

(57) ABSTRACT

An image forming apparatus includes a photoconductor, an exposing unit configured to expose the photoconductor for forming a latent image on the photoconductor based on image data, a developing unit configured to develop, by using toner, the latent image, a transferring unit configured to transfer the image to a sheet, a fixing unit configured to fix toner image transferred onto the sheet, and a control unit configured to divide the image data into a plurality of regions in a sub-scanning direction, determine a target temperature for each region from a result of analyzing the region, and control a temperature of the fixing unit based on the determined target temperature.

14 Claims, 11 Drawing Sheets

FIG. 3A

302

301

| | | | | | | | | | | | |
|---|---|---|---|---|---|---|---|---|---|---|---|
| 120 | 110 | 110 | 70 | 70 | 70 | 70 | 70 | 70 | 70 | 70 | 70 |
| 130 | 120 | 110 | 70 | 70 | 70 | 70 | 70 | 70 | 70 | 70 | 70 |
| 130 | 130 | 120 | 70 | 70 | 70 | 70 | 70 | 70 | 70 | 70 | 70 |
| 140 | 130 | 130 | 120 | 110 | 110 | 70 | 70 | 70 | 70 | 70 | 70 |
| 150 | 140 | 130 | 130 | 120 | 110 | 70 | 70 | 70 | 70 | 70 | 70 |
| 150 | 150 | 140 | 130 | 130 | 120 | 70 | 70 | 70 | 70 | 70 | 70 |

FIG. 3B

303

| | | | |
|---|---|---|---|
| 120 | 100 | 90 | 70 |
| 140 | 120 | 70 | 70 |

FIG. 3C

304

305

306

307

175

150

180

160

L × L × L × L

FIG. 6A

501

| MEDIUM TYPE | THICK PAPER | PLAIN PAPER | THIN PAPER |
|---|---|---|---|
| PROCESSING SPEED (Ps) [mm/s] | 60 | 100 | 200 |

FIG. 6B

502

504

| PROCESSING SPEED (Ps) [mm/s] | 60 | 100 | 200 |
|---|---|---|---|
| Y EXPOSURE UNIT-FIXING NIP TOTAL DISTANCE [mm] | 500 | | |
| FIXING TEMPERATURE INCREASE RATE ($T_{rate}$) [°C/s] | 8 | | |
| MAXIMUM TEMPERATURE ADJUSTMENT WIDTH ($T_{target}$) [°C] | 10 | | |
| Y EXPOSURE UNIT-FIXING NIP TIME ($P_{time}$) [s] | 8.3 | 5 | 2.5 |
| REGION SIZE UPPER LIMIT ($L_{max}$) [line] | 11000 | 8900 | 6000 |

FIG. 6C

503

| PROCESSING SPEED | 60 [mm/s] | 100 [mm/s] | 200 [mm/s] |
|---|---|---|---|
| MEDIUM SIZE (M) [line] | REGION SIZE L [line] | | |
| 5000 | 5000 (1) | 5000 (1) | 5000 (1) |
| 7800 | 7800 (1) | 7800 (1) | 3900 (2) |
| 28000 | 9400 (3) | 7000 (4) | 5600 (5) |

FIG. 9

| PROCESSING SPEED (Ps) [mm/s] | 60 | 100 | 200 |
|---|---|---|---|
| FIXING TEMPERATURE INCREASE RATE ($T_{rate}$) [°C/s] | 8 | | |
| MAXIMUM TEMPERATURE ADJUSTMENT WIDTH ($T_{target}$) [°C] | 10 | | |
| REGION SIZE LOWER LIMIT ($L_{min}$) [line] | 1700 | 2900 | 5900 |

IMAGE FORMING APPARATUS WHICH DIVIDES IMAGE DATA INTO A PLURALITY OF REGIONS AND CONTROLS FIXING TEMPERATURE ACCORDINGLY

BACKGROUND OF THE INVENTION

Field of the Invention

The aspect of the embodiments relates to an image forming apparatus.

Description of the Related Art

A technology for an image forming apparatus thermally fixing a toner image formed by electrophotography has been known which determines the fixing temperature in a fixing device based on the amount of colorant (hereinafter, called a toner amount) applied onto recording paper. In recent years, a technology has been known which measures the toner application amount with high accuracy for control for an optimum fixing temperature so that fixing failure due to an insufficient fixing temperature can be prevented, and, at the same time, fixing in an over-temperature can be inhibited for reduction of power consumption.

Japanese Patent Laid-Open No. 2015-55747 discloses a technology, which, in a case where page editing/printing is performed, such as a case where a plurality of pages is aggregated into one page, a toner application amount is measured for each division region on recording paper so that control for an optimum fixing temperature can be executed.

SUMMARY OF THE INVENTION

An image forming apparatus includes a photoconductor, an exposing unit configured to expose the photoconductor for forming a latent image on the photoconductor based on image data, a developing unit configured to develop, by using toner, the latent image, a transferring unit configured to transfer the image to a sheet, a fixing unit configured to fix toner image transferred onto the sheet, and a control unit configured to divide the image data into a plurality of regions in a sub-scanning direction, determine a target temperature for each region from a result of analyzing the region, and control a temperature of the fixing unit based on the determined target temperature.

Further features of the disclosure will become apparent from the following description of exemplary embodiments with reference to the attached drawings.

BRIEF DESCRIPTION OF THE DRAWINGS

FIGS. 3A to 3C illustrate a toner application amount detecting method.

FIGS. 6A to 6C illustrate a method for determining the size of a region for toner application amount detection.

FIG. 9 illustrates property values in the image forming apparatus.

DESCRIPTION OF THE EMBODIMENTS

Features of the disclosure will become apparent from the following description of exemplary embodiments with reference to drawings.

System Configuration

First Embodiment

Figure 1:
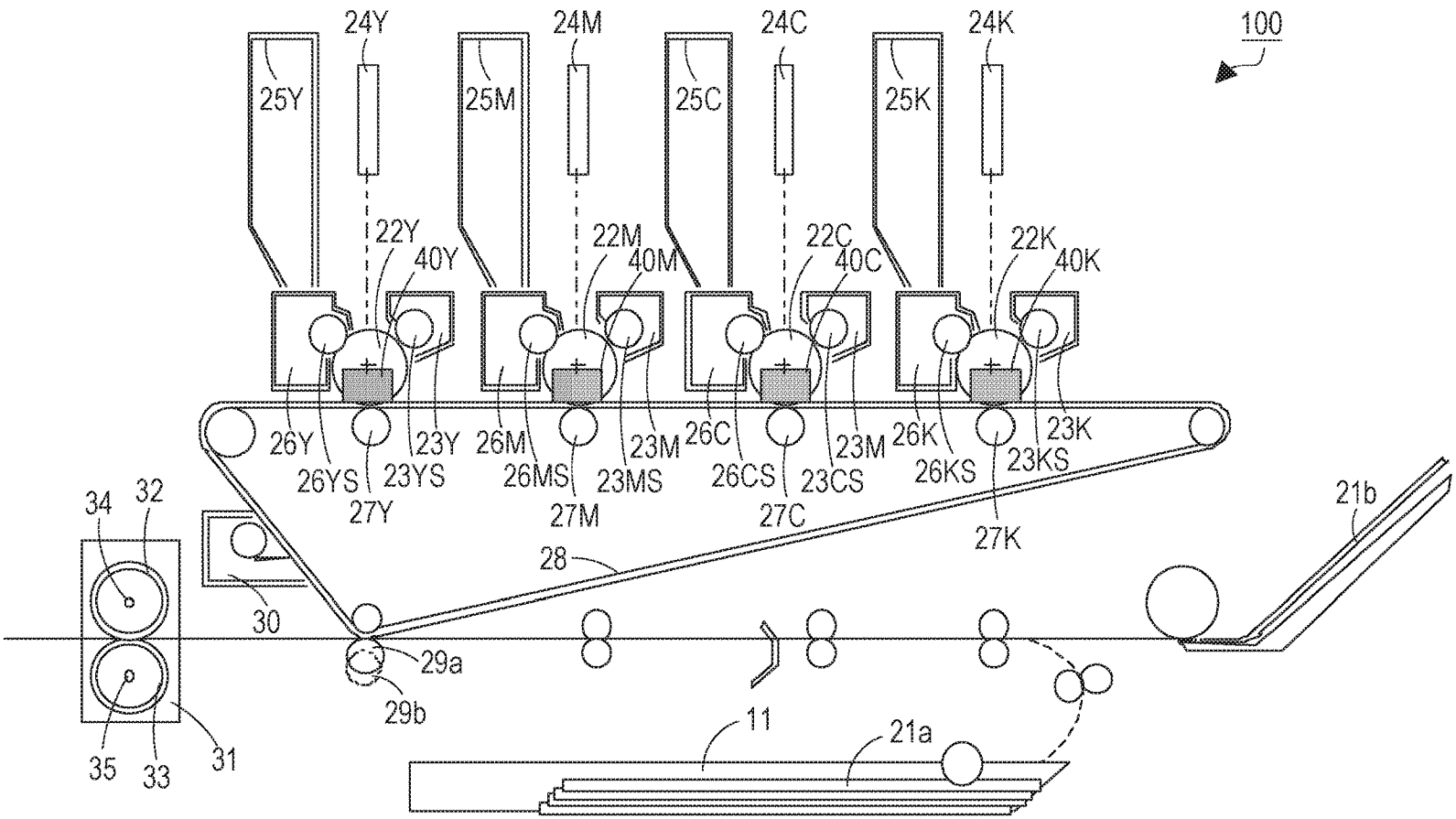
FIG. 1 is a cross-sectional view of an image forming apparatus.

FIG. 1 is a cross-sectional view of an electrophotographic image forming apparatus according to this embodiment. An image forming apparatus 100 is a tandem system color image forming apparatus applying an intermediate transfer member 28. According to this embodiment, a multi-functional apparatus is an example of the image forming apparatus. In the multi-functional apparatus, image formation units which develop a latent image formed by image forming devices for different colors by using toners of the different colors are arranged at predetermined intervals in a direction of conveyance of a sheet so that the toners of the different colors can be multi-transferred to the sheet to form a color image. The image forming apparatus 100 includes a fixing unit 31 configured to perform thermal pressurizing processing on a toner image transferred to a sheet. According to this embodiment, the attributes of a fed sheet is identified based on the type and thickness of the sheet and the length of the sheet in a sub-scanning direction for conveying the sheet. The fixing unit 31 is configured to develop by using toner a latent image formed by image forming unit based on image data and then perform processing for thermally pressuring and fixing the toner image transferred to the conveyed sheet.

Referring to FIG. 1, a charging unit includes four injection chargers 23Y, 23M, 23C, and 23K configured to electrostatically charge photoconductors 22Y, 22M, 22C, and 22K for colors of Y, M, C, and K, respectively. The injection chargers 23Y, 23M, 23C, and 23K have sleeves 23YS, 23MS, 23CS, and 23KS, respectively.

Driving forces from drive motors 40Y, 40M, 40C, and 40K are transmitted to the photoconductors 22Y, 22M, 22C, and 22K for rotation, and the drive motors 40Y, 40M, 40C, and 40K rotate the photoconductors 22Y, 22M, 22C, and 22K in a counter-clockwise direction based on an image formation operation.

An exposure unit is configured to selectively expose surfaces of the photoconductors 22Y, 22M, 22C, and 22K with laser beams irradiated from the scanner units 24Y, 24M, 24C, and 24K to the photoconductors 22Y, 22M, 22C, and 22K to form an electrostatic latent image.

A developing unit includes four developing devices 26Y, 26M, 26C, and 26K configured to develop for colors of Y, M, C, and K to visualize an electrostatic latent image, and the developing devices 26Y, 26M, 26C, and 26K has sleeves 26YS, 26MS, 26CS, and 26KS. The developing devices 26Y, 26M, 26C, and 26K are detachably attached.

A transfer unit is configured to rotate the intermediate transfer member in clockwise direction to transfer respective single color toner images from the photoconductors to the intermediate transfer member. The single color toner images are transferred by the rotation of the photoconductors Y, M, C, and K and primary transfer rollers Y, M, C, and K opposing thereto. A proper bias voltage is applied to primary transfer rollers, and the rotation speed of the photoconductors is differentiated from the rotation speed of the intermediate transfer member so that the single color toner images can efficiently be transferred onto the intermediate transfer member. This is called a primary transfer.

Furthermore, the transfer unit superimposing the single color toner images of the stations on the intermediate transfer member 28, and the superimposed multi-colored toner image is conveyed by the rotation of the intermediate transfer member 28 to a secondary transfer roller 29. A recording medium 11 is pinched and conveyed from a feed tray 21*a* or a feed tray 21*b* to secondary transfer roller 29, and the multi-colored toner image on the intermediate transfer member 28 is transferred to the recording medium 11. A proper bias voltage is applied to the secondary transfer roller 29 so that the toner image is statistically transferred. This is called a secondary transfer. While the multi-colored toner image is being transferred onto the recording medium 11, the secondary transfer roller 29 is abutted against the recording medium 11 at a position as indicated by the illustrated solid circle in the secondary transfer roller 29 and is separated to a position as indicated by the illustrated broken circle in the secondary transfer roller 29 after printing processing.

A fixing unit includes a fixing roller 32 configured to heat the recording medium 11 and a pressurizing roller 33 configured to press the recording medium 11 to the fixing roller 32 in order to perform melt fixing to the recording medium 11 on the multi-colored toner image transferred to the recording medium 11. The fixing roller 32 and the pressurizing roller 33 are hollow-shaped and internally contain heaters 34 and 35, respectively. The fixing unit 31 conveys the recording medium 11 holding the multi-colored toner image to a nip part between the fixing roller 32 and the pressurizing roller 33 to apply heat and pressure and fixes the toner to the recording medium 11. The recording medium 11 after the toner fixing is discharged to a sheet discharge tray, not illustrated, by a discharge roller, not illustrated, and the image formation operation ends.

A cleaning unit 30 is configured to clean toner left on the intermediate transfer member 28, and residual toner left after the multi-colored toner image in four colors formed on the intermediate transfer member 28 is transferred to the recording medium 11 is stored in a cleaner container.

Figure 2:
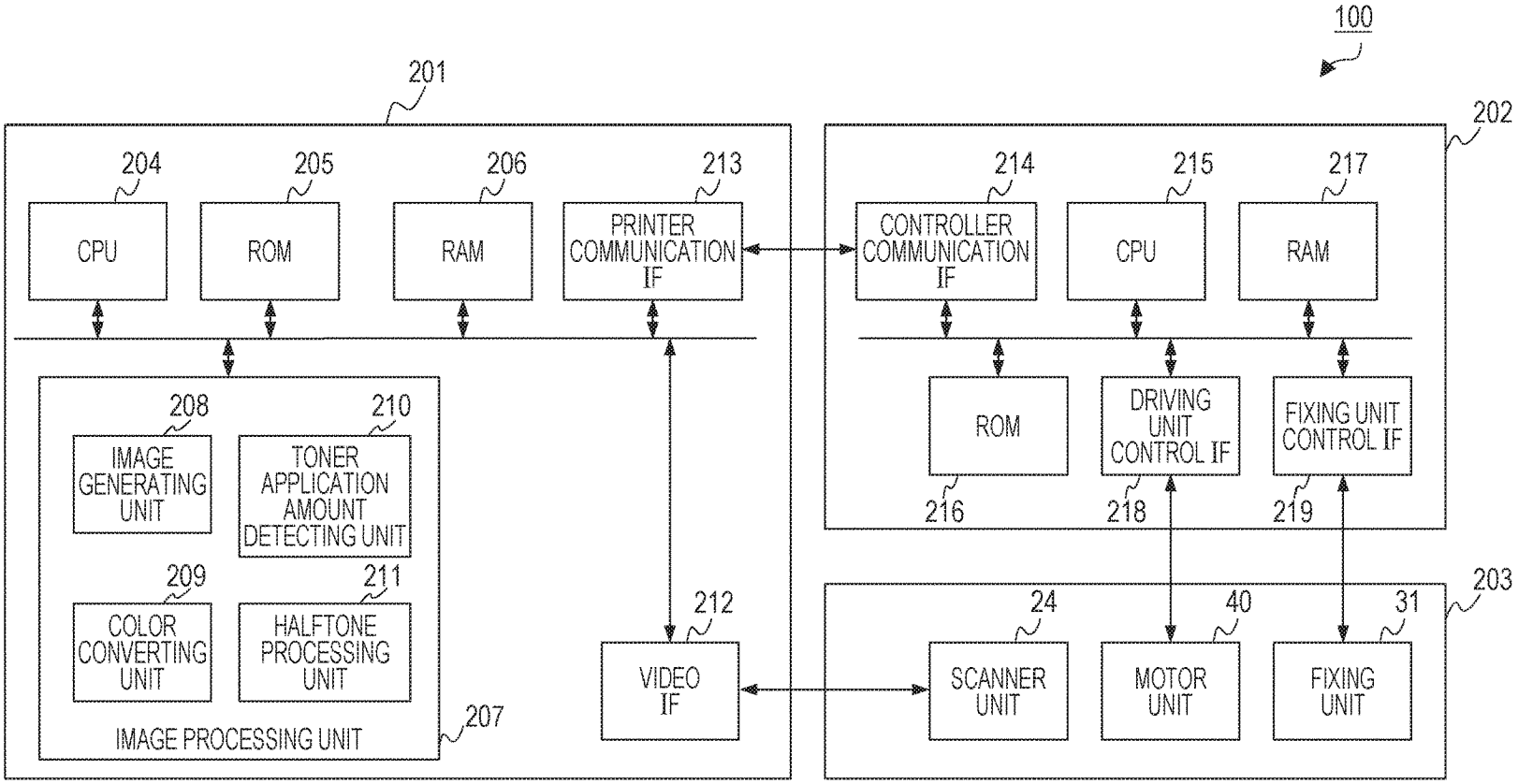
FIG. 2 is a block diagram illustrating a system configuration of the image forming apparatus.

FIG. 2 is a block diagram illustrating a system configuration of the image forming apparatus 100 illustrated in FIG. 1.

Referring to FIG. 2, the image forming apparatus 100 can roughly be divided into a system controller unit 201, a print controller unit 202, and an image forming unit 203. The system controller unit 201 and the print controller unit 202 have CPUs 204 and 215, ROMs 205 and 216, and RAMs 206 and 217, respectively. The CPUs 204 and 215 read out main programs from ROMs 205, 216 in accordance with initial programs within the ROMs 205, 216 and store them in RAMs 206 and 217, respectively. The RAMs 206 and 217 are usable for storing programs and may function as work memories.

An image processing unit 207 includes a series of processing units configured to generate image data that are printable in the image forming unit 203. An image generating unit 208 is configured to generate printable raster image data from print data received from a computer apparatus, not illustrated and output it for each pixel as RGB data and attribute data indicating a data attribute of each pixel. The image generating unit 208 may be configured to handle image data read by a scanning unit installed in the image forming apparatus 100.

The scanning unit here may be a CCD (Charged Couple Device) scanning unit or a CIS (Contact Image Sensor) scanning unit. A processing unit may further be provided additionally which is configured to perform a predetermined image process on the scanned image data. The image generating unit 208 may not be provided in the image forming apparatus 100 but may be configured to externally receive image data through an interface, not illustrated.

A color conversion processing unit 209 is configured to convert RGB data to a CMYK color space based on toner color and generate CMYK data and attribute data. The image data in this step is data indicating the CMYK toner amount and may be represented by an 8-bit value of 0 to 255, for example, for each pixel unit. As a concrete value, colors with 0 indicate that toner is not used. As the value increases, the density increases. A value of 255 indicates a maximum density of each color. A toner amount of 255 indicates 100%, and a value acquired by adding toner amounts of colors of CMYK at a pixel position represents a toner application amount at the pixel position.

A toner application amount detecting unit 210 detects a toner application amount by executing an analysis process on print data for CMYK data generated by the color conversion processing unit 209. A specific method for detecting a toner application amount will be described with reference to FIGS. 3A to 3C. The application amount information detected by the toner application amount detecting unit 210 is notified to the print controller unit 202.

A halftone processing unit 211 is configured to perform a halftone process on the CMYK data output from the toner application amount detecting unit 210. The halftone processing unit 211 may specifically be based on screen processing or by error diffusion processing. The screen processing converts CMYK data input by using a predetermined plurality of dither matrices to an N-ary value. The error diffusion processing converts input CMYK data to an N-ary value by comparing the data with a predetermined threshold value and diffuses the difference between the CMYK data and the threshold value to ambient pixels to be N-ary converted thereafter.

The CMYK data having undergone the halftone processing in the image processing unit 207 are transferred to the scanner units 24Y, 24M, 24C, and 24K in synchronism with a VIDEO synchronization signal through a VIDEO IF unit 212.

A printer communication IF unit 213 and a controller communication IF unit 214 are provided for communication between the system controller unit 201 and the print controller unit 202. Information to be communicated here may include a control signal from the system controller unit 201 and toner application amount information detected by the toner application amount detecting unit 210. A CPU 215 is configured to calculate a fixing temperature based on the notified toner application amount information. Details of the method for calculating a fixing temperature from the toner application amount information will be described below with reference to FIG. 4.

The CPU 215 is configured to control the heaters 34 and 35 in the fixing unit 31 to obtain the calculated fixing temperature. The CPU 215 is configured to control a series of motors including a drive motor unit 40 such that the image forming unit 203 can perform image formation at a predetermined process speed. The process speed is defined based on the type of medium such as thick paper and thin paper and is controlled such that the fixing unit 31 can perform thermal fixing on media having different heat capacities.

More specifically, the CPU 215 is configured to control the fixing temperature of the fixing unit 31 in accordance with the toner application amount on the detected temperature adjustment regions and based on the temperature adjustment regions on a sheet having transferred toner thereon and passing through a nip position of the fixing unit 31. The CPU 215 can complete the temperature adjustment control over the fixing unit 31 before the leading ends of the temperature adjustment regions determined by the processing, which will be described below, reach the nip position of the fixing unit 31.

FIGS. 3A to 3C illustrate a toner application amount detecting method to be executed in the toner application amount detecting unit 210 illustrated in FIG. 2.

Here, the term "toner application amount" refers to an amount of toner to be applied per unit area of a medium on which printing is to be performed, and the toner application amount is described in unit of %. More specifically, it is assumed that maximum values (255 as an 8-bit value) of colors of CMYK are 100%, and the toner amount is equal to 200% at a pixel position where two colors of the maximum values are overlaid. Because, in addition to CMYK colors, 256 tones are provided if represented by 8-bit values, the toner amount of each of the colors is possibly equal to a value in a range of 0 to 100%. For example, an image produced with four color toners of CMYK in a full-color print mode has a higher toner application amount while a black-and-white image produced with single color of K have a lower toner application amount.

First of all, the toner application amount detecting unit 210 calculates a total toner application amount based on tones of four colors of CMYK at pixel positions corresponding to input data to be processed. Here, the input data is received from an information processing apparatus over a network or through an interface cable.

FIG. 3A illustrate toner application amounts at pixel positions of input data, and a numerical values indicated within each of pixel frames corresponds to a toner application amount 301 at the pixel position.

Next, from the toner application amounts 301 at the pixel positions, the toner application amount detecting unit 210 calculates an average value of the toner application amounts at the pixels included in a 3×3 pixel window 302. The toner application amount detecting unit 210 performs convolution averaging processing based on the 3×3 pixel window 302 on all pixels included in a page. The 3×3 pixel window 302 is used here because the temperature for fixing depends on not only the toner application amount but also the size of an object to be drawn.

The size of pixel window is not limited to 3×3, but an arbitrary size may be applied. According to this embodiment, an average value is used as a representative value at a window position, but the representative value may be a maximum value or a minimum value thereat.

FIG. 3B illustrates an exemplary toner amount representative value 303 after the convolution processing based on the 3×3 pixel window 302. The convolution processing is continuously performed in the main-scanning direction. After processing on one line is performed, the processing moves to the next line to process all pixels within a page.

Next, the toner application amount detecting unit 210 continuously performs the convolution processing in the sub-scanning direction as illustrated in FIG. 3C, and, at the same time, a maximum value of representative values included in a region 304 of a predetermined number of lines (division region size) L is determined as a toner application amount maximum value [175] in the region 304. The toner application maximum value determined in the image processing unit 207 is notified from the system controller unit 201 to the print controller unit 202. This processing is repeated on each of the regions 304 to 307 having the number of lines (division region size) L. A method for determining the number of lines (division region size) L and the reason for dividing into regions will be described below.

FIG. 3C illustrates exemplary maximum values of the toner application amount determined for each of the regions 304 to 307 having the number of lines (division region size) L.

The print controller unit 202 is configured to control the fixing temperature of the fixing unit 31 based on the toner application amount information notified for each of sub-scanning regions.

Figure 4:
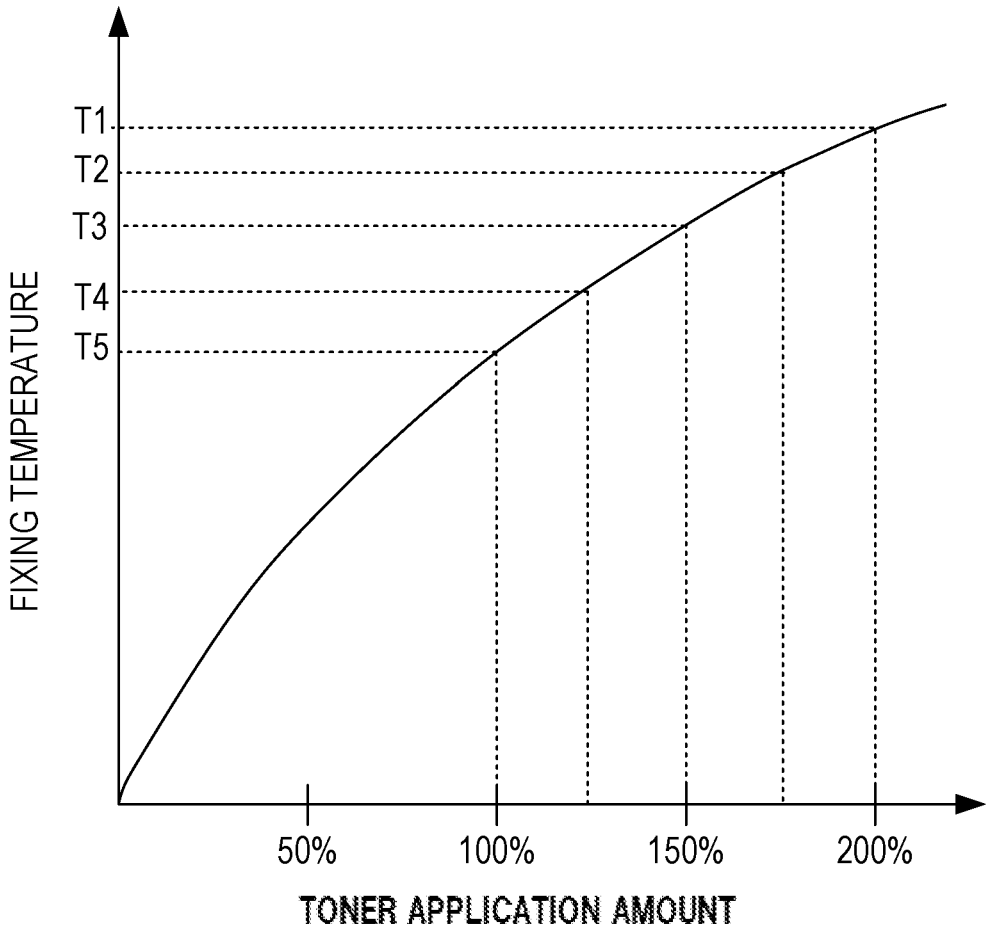
FIG. 4 illustrates a relationship between toner application amount and fixing temperature.

FIG. 4 is a property diagram illustrating a relationship between toner application amount and minimum fixing temperature for fixing toner for each toner application amount to a medium to be printed. The property diagram has a vertical axis indicating fixing temperature T and a horizontal axis indicating toner application amount %. The medium here may be any type of paper such as thick paper, plain paper, and thin paper.

The toner application amount is a toner amount to be applied for each unit area of a medium to be printed. In order to fix toner to a medium to be printed without fixing failures, the fixing temperature of the fixing unit 31 may be determined in accordance with a drawing object having a maximum toner application amount within a certain region.

As illustrated in FIG. 4, as the maximum toner application amount in a region increases, the minimum temperature for fixing increases. The property illustrated in FIG. 4 may be stored in the ROM 216 as a look-up table (LUT) and may be calculated by the CPU 215 in the print controller unit 202 from property data associated with FIG. 4. Alternatively, the system controller unit 201 may be configured to acquire the fixing temperature by applying the same method and then notify it to the print controller unit 202.

Figure 5A:
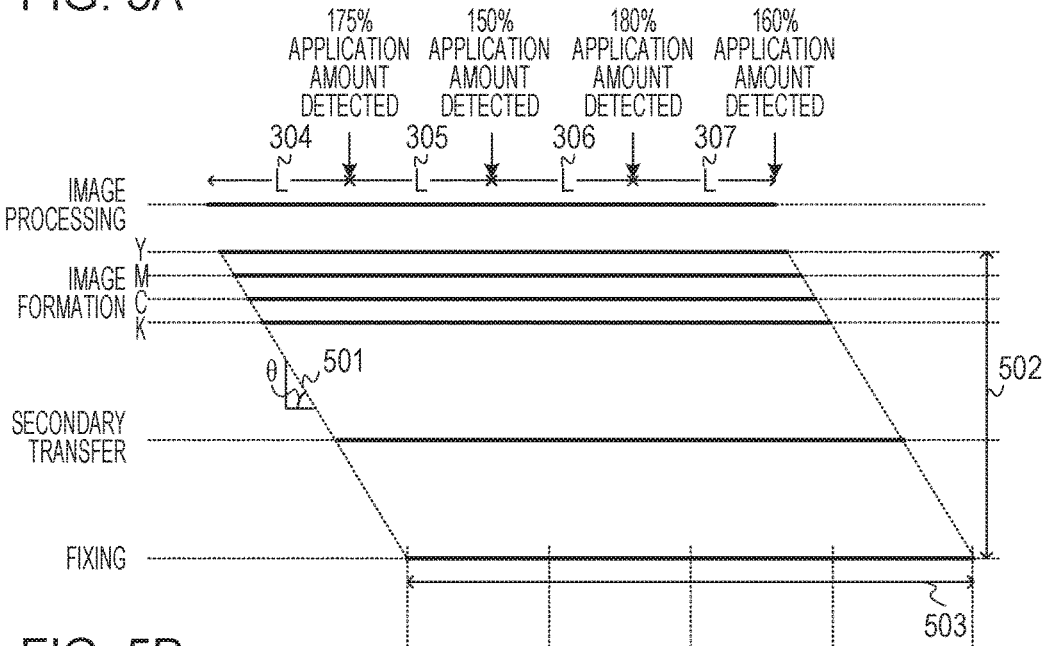
FIGS. 5A to 5C illustrate an application amount detection processing and timing for fixing temperature control.
Figure 5B:
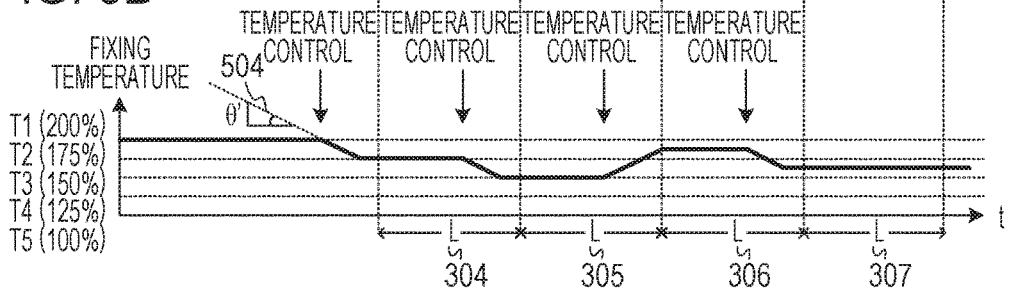
Figure 5C:
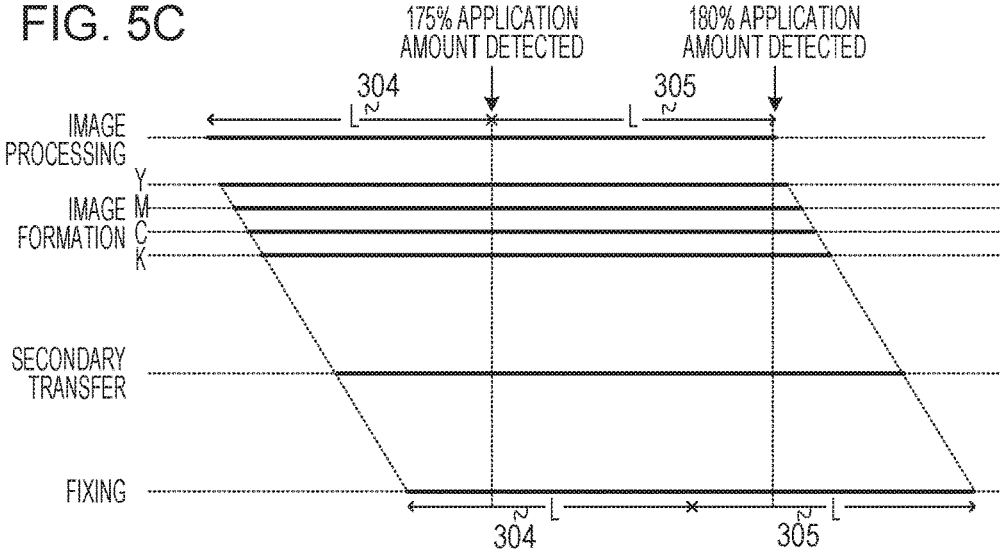

FIGS. 5A to 5C illustrate toner application amount calculation processing in the image processing unit 207 illustrated in FIG. 2 and timing for fixing temperature control.

FIG. 5A illustrates a relationship between a series of image processes including a toner application amount calculation process in the toner application amount detecting unit 210 and a series of image formation processes including a fixing process in the image forming unit 203.

FIG. 5A has horizontal axes indicating time and vertical axes indicating processes of an image process in the image processing unit 207, image formation (including electrostatically charging, exposing, developing, and primary transfer) in the image forming unit 203, secondary transfer, and fixing.

The thick solid lines of the horizontal axes in FIG. 5A represent processes from an image process to fixing for one page.

Image data processed in the image processing unit 207 undergo electrostatic latent image formation, development, and primary transfer for sequentially from Y to the intermediate transfer member 28 for image formation in accordance with the relationship of arrangement of the photoconductors 22Y, 22M, 22C, and 22K. The angle (θ) 501 of the broken line connecting between processes indicate a process speed. As the process speed increases, the angle to the perpendicular line decreases. As the process speed decreases, the angle to the horizontal line decreases.

A distance 502 between items on the vertical axis represents a total distance from the exposure unit in the photoconductor 22 to the nip part in the fixing unit 31 through the intermediate transfer member 28. The solid line on the horizontal axis represents processing for one page and has a medium size 503 having a length depending on the medium size 503.

FIG. 5B is a timing chart illustrating fixing temperature control based on results of calculation of a toner application amount corresponding to FIG. 5A. FIG. 5C has a horizontal axis indicating time and a vertical axis indicating fixing temperature.

As illustrated in FIG. 5B, the print controller unit 202 controls the fixing temperature based on the maximum value of the toner application amount detected for each of the regions 304 to 307 by the toner application amount detecting unit 210. An angle (θ') (corresponding to a fixing temperature increase rate) 504 indicating a rate of change in the illustrated fixing temperature represents a rate of change in temperature of the fixing roller 32 and the pressurizing roller 33.

As illustrated in FIGS. 5A and 5B, for example, in a case where the toner application amount maximum value of the first region 304 in FIG. 3C is 175%, the fixing temperature can be reduced to T2 while the region 304 of the conveyed medium is passing through the fixing unit 31. Also, the fixing temperature can be reduced to T3 while the region 305 on the conveyed medium is passing through the fixing nip portion of the fixing unit 31.

In a case where the fixing temperature control is performed in real time based on a result of toner application amount detection, the fixing temperature control is to be completed certainly before the regions 304 to 307 of a medium enter to the fixing nip portion of the fixing unit 31. This can be achieved by dividing a region for detecting toner application amount (hereinafter, sometimes called a toner application amount detection region) into a plurality of regions each having the number of lines (division region size) L based on the process speed 501, the total distance 502 of the image forming unit, the medium size 503, and the fixing temperature increase rate 504 and performing fixing temperature control in optimum timing.

For example, in a case where, as illustrated in FIG. 5C, the number of lines (division region size) L is higher than that of FIG. 5A, a part of the region 304 has already entered to the fixing unit 31 when the maximum application amount on the region 304 is detected. Also when the maximum application amount on the region 305 is calculated, a part of the region 305 has entered to the fixing nip portion of the fixing unit 31. Here, in a case where the part having entered to the fixing nip portion of the fixing unit 31 of each region has a region having a higher toner application amount, there may possibly be not enough time for increasing the fixing temperature of the fixing unit 31 to a fixing temperature.

Also, in a case where the part having entered to the fixing nip portion of the fixing unit 31 of each of the regions has a region having a lower toner application amount, the fixing temperature cannot be reduced to a minimum temperature, which causes wasteful power consumption due to the excess fixing temperature.

However, as illustrated in FIGS. 5A and 5B, the toner application amount detection and the fixing temperature control are performed on division regions each having a proper number of lines (division region size) L so that the fixing temperature can be controlled to be reduced to a target temperature certainly before the regions 304 to 307 pass through the fixing nip portion of the fixing unit 31. The reason has been described for dividing the region for calculating a toner application amount into a plurality of division regions in a sub-scanning direction as in FIG. 3C.

FIGS. 6A to 6C illustrate a method for determining the number of lines (division region size) L based on the process speed 501, the total distance 502 of the image forming unit, the medium size 503, and the fixing temperature increase rate 504 illustrated in FIGS. 5A to 5C.

FIG. 6A illustrates an exemplary correspondence between medium type and the process speed 501.

The image forming apparatus 100 supports three medium types including thick paper, plain paper, and thin paper. The process speed 501 is controlled based on the heat capacity depending on the basis weight of each medium type. As the heat capacity increases, the process speed 501 decreases. As the heat capacity decreases, the process speed 501 increases.

FIG. 6B illustrates an upper limit value [line] of the number of lines (division region size) L of each of division regions of a toner application amount detection region which can provide sufficient time for securely performing fixing temperature control from the toner application amount detection in a case where a temperature adjustment width is given.

A maximum temperature adjustment width [$T_{target}$] indicates a maximum width of a control range (such as T1 to T5) to the fixing temperature illustrated in FIG. 4. A Y exposure unit-fixing nip (Nip) time can be acquired by dividing the total distance 502 between the Y exposure unit and the fixing nip by the process speed 501.

A region size upper limit value [$L_{max}$] satisfies the following Expression (1).

$$\left(P_{time} - \frac{L_{max}}{P_s}\right) \times T_{rate} \geq T_{target} \tag{1}$$

where Ps [mm/s] is the process speed 501, $P_{time}$ [s] is a Y exposure unit-fixing nip time, $T_{rate}$ [° C./s] is the fixing temperature increase rate 504, and $T_{target}$ [° C.] is a maximum temperature adjustment width.

When the process speed 501 (Ps[mm/s]) changes, the region size upper limit value [$L_{max}$] indicates an upper limit value of the division region size L for completing the fixing temperature control before a medium enters to the fixing nip portion of the fixing unit 31.

The value in the left parenthesis in Expression (1) indicates a grace time for one region from determination of the maximum toner application amount at a rear end of the region to entry of the initial position of the region to the fixing nip portion of the fixing unit 31. If the value acquired by multiplying the grace time by the fixing temperature increase rate $T_{rate}$ [° C./s] is higher than the maximum temperature adjustment width $T_{target}$ [° C.], the fixing temperature control can certainly be performed on time.

FIG. 6C illustrates a correspondence relationship between three medium sizes (M) supported by the image forming apparatus 100 and region size L [line] where a region size upper limit value $L_{max}$ is given. The numbers in parentheses indicate the number of region divisions in a case where image data for one page is divided into a plurality of regions. The region size L to be acquired satisfies the following Expression (2).

$$L = \frac{M}{N} \leq L_{max} \tag{2}$$

where the number of division regions is an integer N and the medium size is M.

The number of division regions N is an integer for prevention of a case that the fixing temperature increase rate of the fixing unit 31 from reaching a temperature adjustment width because the number of division regions not being an integer causes a region having a fractional size. This will be described in detail in descriptions of a second embodiment. In a case where the region size upper limit value $L_{max}$ is higher than the medium size M as illustrated in FIG. 6C, the number of division regions N=1, and the region is not divided.

Figure 7:
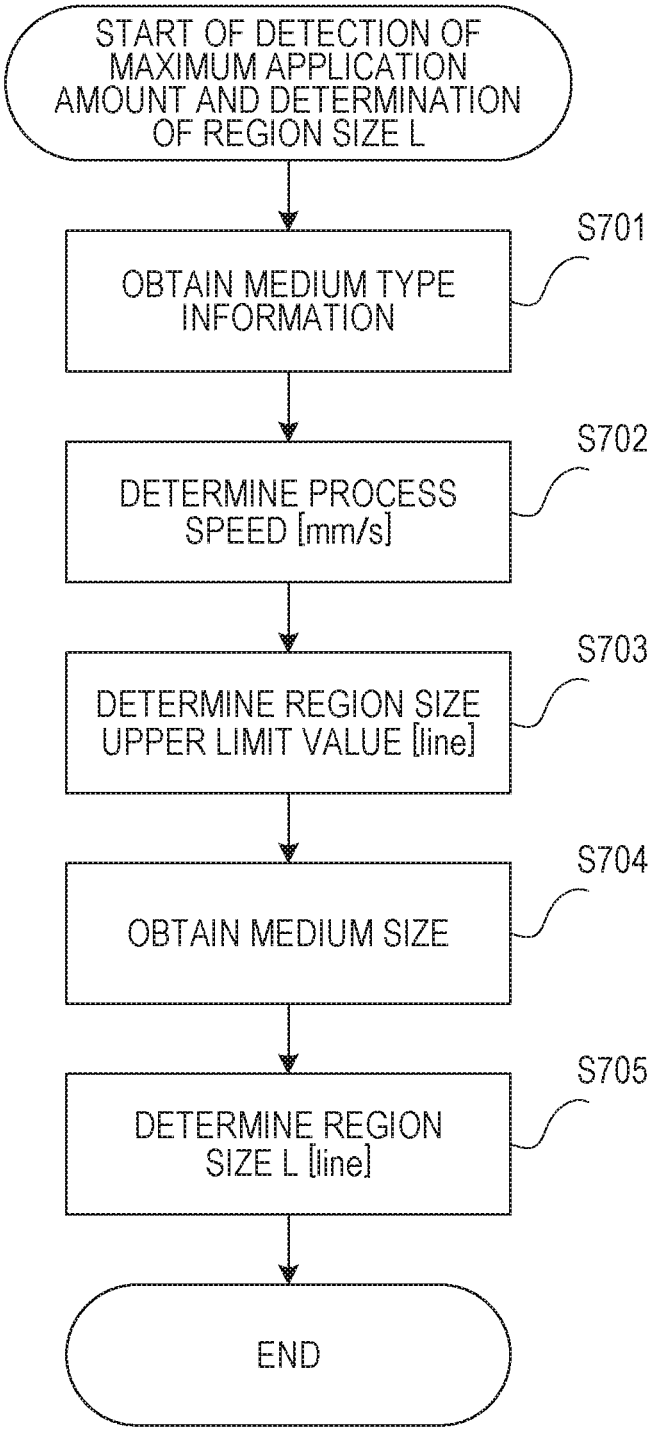
FIG. 7 is a flowchart illustrating a control method for the image forming apparatus.

FIG. 7 is a flowchart illustrating a control method for the image forming apparatus according to this embodiment. FIG. 7 illustrates an example in which Expressions (1) and (2) above are used to determine the number of lines (division region size) L as illustrated in FIG. 4. Each step (hereinafter, S) has processing to be performed after the CPU 204 decompresses a program stored in the ROM 205 in the system controller unit 201 onto the RAM 206. Processing will described including starting the processing based on image data, developing a latent image formed by the image forming unit with toner, and determining the size (region size (L)) of a temperature adjustment region for completing adjustment of the fixing temperature of the fixing unit in a divided manner while the image region having the toner transferred to the conveyed sheet is passing through the nip position of the fixing unit 31.

In S701, the CPU 204 obtains medium type information regarding a current subject page from job information to be processed. In S702, the CPU 204 determines a process speed Ps [mm/s] as illustrated in FIG. 6A from the medium type information obtained in S701. In S703, the CPU 204 determines a region size upper limit value [$L_{max}$] from the process speed Ps [mm/s] determined in S702 and Expression (1). In S704, the CPU 204 obtains a medium size M of the current subject page from the job information to be processed. In S705, the CPU 204 determines a region size L [line] from the region size upper limit value [$L_{max}$] determined in S703, the medium size M obtained in S704, and Expression (2), and this processing ends. The determined region size L [line] is stored in the RAM 206 or the RAM 217.

By performing this processing, a proper (certain) region size for completing adjustment of the fixing temperature of the fixing unit 31 in a divided manner can be determined based on the process speed of the image forming unit, a sheet attribute, the distance between the image formation position in the image forming unit and the nip position in the fixing unit 31, and the temperature increase rate of the fixing unit 31.

Also, by performing this processing, the size of a certain temperature adjustment region can be determined based on the upper limit value of the size of region for completing adjustment of the fixing temperature of the fixing unit 31 in a divided manner and the length in the sub-scanning direction of a sheet, for example. Thus, the temperature adjustment region adapted to the process speed for forming an image can be determined, and the adjustment of the fixing temperature can be completed before the leading edge of each of temperature adjustment regions passes through the nip position of the fixing unit 31.

Figure 8:
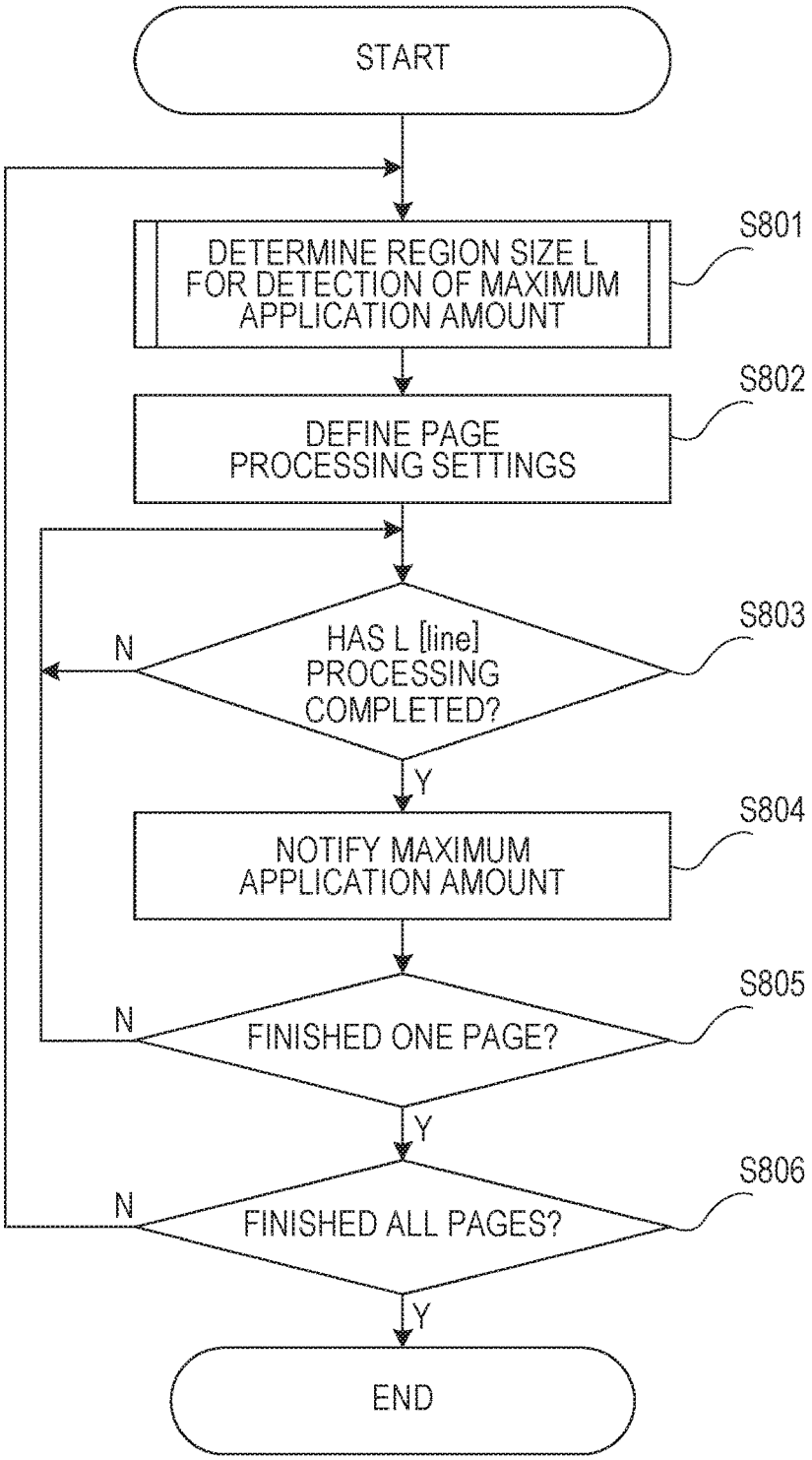
FIG. 8 is a flowchart illustrating a control method for the image forming apparatus.

FIG. 8 is a flowchart illustrating a control method for the image forming apparatus according to this embodiment. FIG. 8 illustrates a print job control example including toner application amount detection processing. Each step (hereinafter, S) has processing to be performed after the CPU 204 decompresses a program stored in the ROM 205 in the system controller unit 201 onto the RAM 206. Processing will be described in detail including analyzing image data for each temperature adjustment region determined in the processing illustrated in FIG. 7, detecting the application amount of toner transferred to the previous sheet, and notifying the detected toner application amount to the print controller unit 202.

In S801, the CPU 204 determines a region size L based on medium information regarding each page included in job information to be processed. Details of the processing are as illustrated in FIG. 7.

In S802, the CPU 204 sets process parameters for the page for the image processing unit 207 based on the job information. This step further includes setting the region size L for the toner application amount detecting unit 210. Control information for controlling the image forming unit 203 including a process speed Ps [mm/s] and a medium type is notified to the print controller unit 202, and the print job is started.

In S803, the CPU 204 waits until detection of the toner application amount for the region size L determined in S801 completes. The number of processed lines may be determined based on a notification of a count value of a line counter included in the toner application amount detecting unit 210 by interrupting to the CPU 204 or may be determined by using another number-of-processed lines determining unit.

In S804, the CPU 204 notifies the toner application amount maximum value of the region 304 detected by the toner application amount detecting unit 210 to the print controller unit 202. The print controller unit 202 determines the fixing temperature based on the toner application amount and controls the fixing temperature of the fixing unit 31 to a target temperature, as illustrated in FIG. 4.

In S805, the CPU 204 determines whether the processing for one page has completed or not, that is, processing on all division regions has completed or not. If the CPU 204 determines that the processing has not completed, the processing returns to S803. As illustrated in FIG. 6C, in a case where the number of division regions is equal to 1, that is, in a case where no division is performed, the CPU 204 advances the processing to S806 without fail.

In a case where the number of division regions is equal to or higher than 2, the CPU 204 repeats the processing in S803 and S804 until the processing on all of the division regions completes. Next, in S806, the CPU 204 determines whether the process for notifying a maximum application amount for all pages included in the print job has completed or not. If it is determined that there are unprocessed pages, the CPU 204 returns the process to S801.

On the other hand, if the CPU 204 determines that the processing for notifying a maximum application amount for all pages has completed, the processing ends.

According to this embodiment, appropriate fixing temperature control can be performed even in a case where the processing for detecting a toner application amount is performed in real time simultaneously with start of image processing on a print job.

Particularly, the region division is performed based on a medium type and a medium size so that proper fixing temperature control can be performed. The fixing temperature control can assure prevention of fixing failure and can reduce power consumption greatly.

Second Embodiment

According to this embodiment, a region size L can be dynamically changed, instead of a fixed region size L as in the first embodiment, to highly accurately perform fixing temperature control based on a calculated toner application amount.

Because toner application amount detection processing and fixing temperature control according to this embodiment are the same as those of the first embodiment, any repetitive description will be omitted.

FIG. 9 illustrates parameters for determining a region size L in an image forming apparatus according to this embodiment. FIG. 9 illustrates an example in which process speed, fixing temperature increase rate, maximum temperature adjustment width, and region size lower limit value $L_{min}$ are provided as the parameters. A region size lower limit value $L_{min}$ [line] satisfies the following Expression (3).

$$L_{min} \geq \frac{P_s}{T_{rate}} \times T_{target} \tag{3}$$

where Ps [mm/s] is a process speed, $T_{rate}$ [° C./s] is a fixing temperature increase rate, and $T_{target}$ [° C.] is a maximum temperature adjustment width.

The distance of conveyance of a medium per unit temperature change can be acquired by dividing the process speed Ps [mm/s] by the fixing temperature increase rate $T_{rate}$ [° C./s], which is then multiplied by the maximum temperature adjustment width $T_{target}$ [° C.] to acquire a region size lower limit value $L_{min}$ for controlling the fixing temperature to the target temperature.

Figure 10:
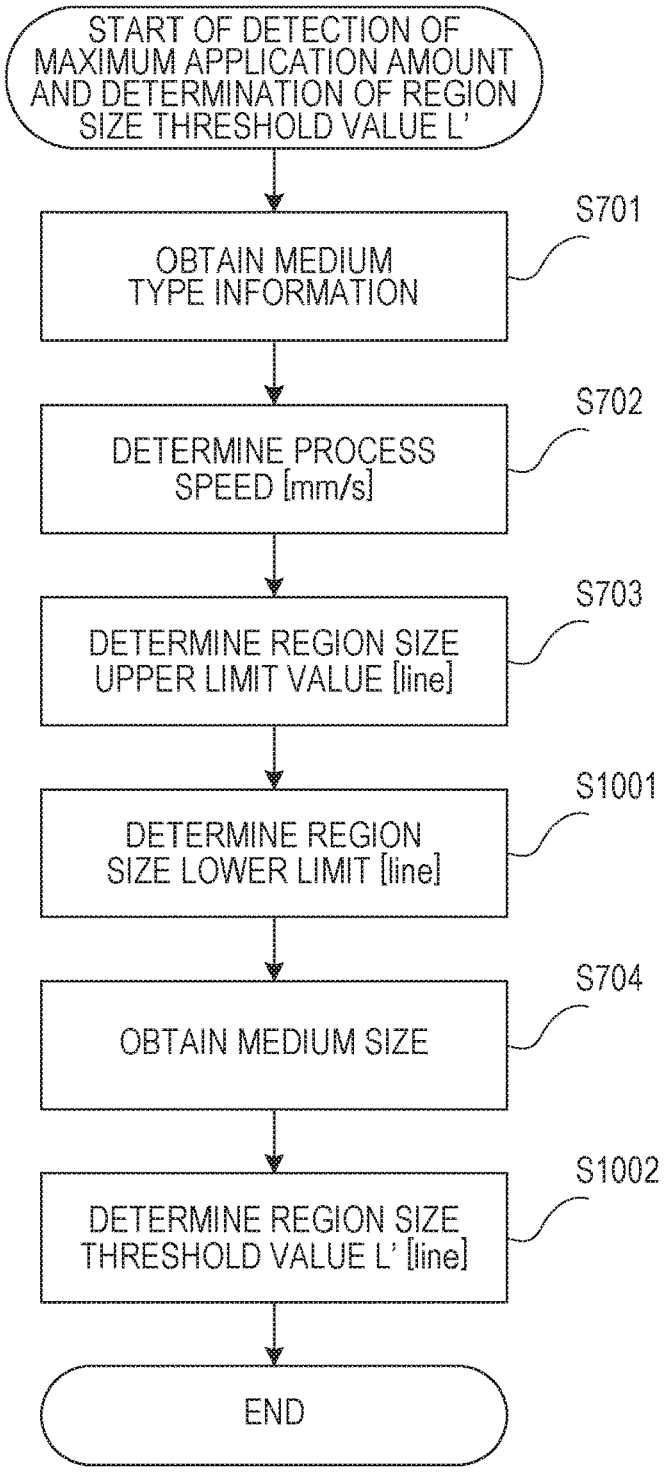
FIG. 10 is a flowchart illustrating a control method for the image forming apparatus.

FIG. 10 is a flowchart illustrating a control method for an image forming apparatus according to this embodiment. FIG. 10 illustrates a processing example for acquiring a region size threshold value [L'] for dynamic change of a region size. Each step (hereinafter, S) has processing to be performed after the CPU 204 decompresses a program stored in the ROM 205 in the system controller unit 201 onto the RAM 206. The processing in S701 to S704 is the same as that according to the first embodiment.

In S1001, the CPU 204 determines a region size lower limit value $L_{min}$. It can be determined by the method as illustrated in FIG. 9. In S1002, the CPU 204 determines the region size threshold value L' such that it can fall within a range between the upper limit value determined in S703 and the lower limit value determined in S1001. As the difference between the threshold value and the lower limit value decreases, the accuracy can increase while the process load also increases. Therefore, the threshold value is to be determined in consideration of the loads on the CPU 204 in the system controller unit 201 and the CPU 215 in the print controller unit 202.

By performing this processing, a proper variable size of a temperature adjustment region can be determined based on the upper limit value determined in S703 in FIG. 7 of the variable size of the temperature adjustment region for adjusting the fixing temperature of the fixing unit 31 in a divided manner and the lower limit value of the region size in which the adjustment in a divided manner is completed (S1001), and the length of a sheet in a sub-scanning direction.

Figure 11:
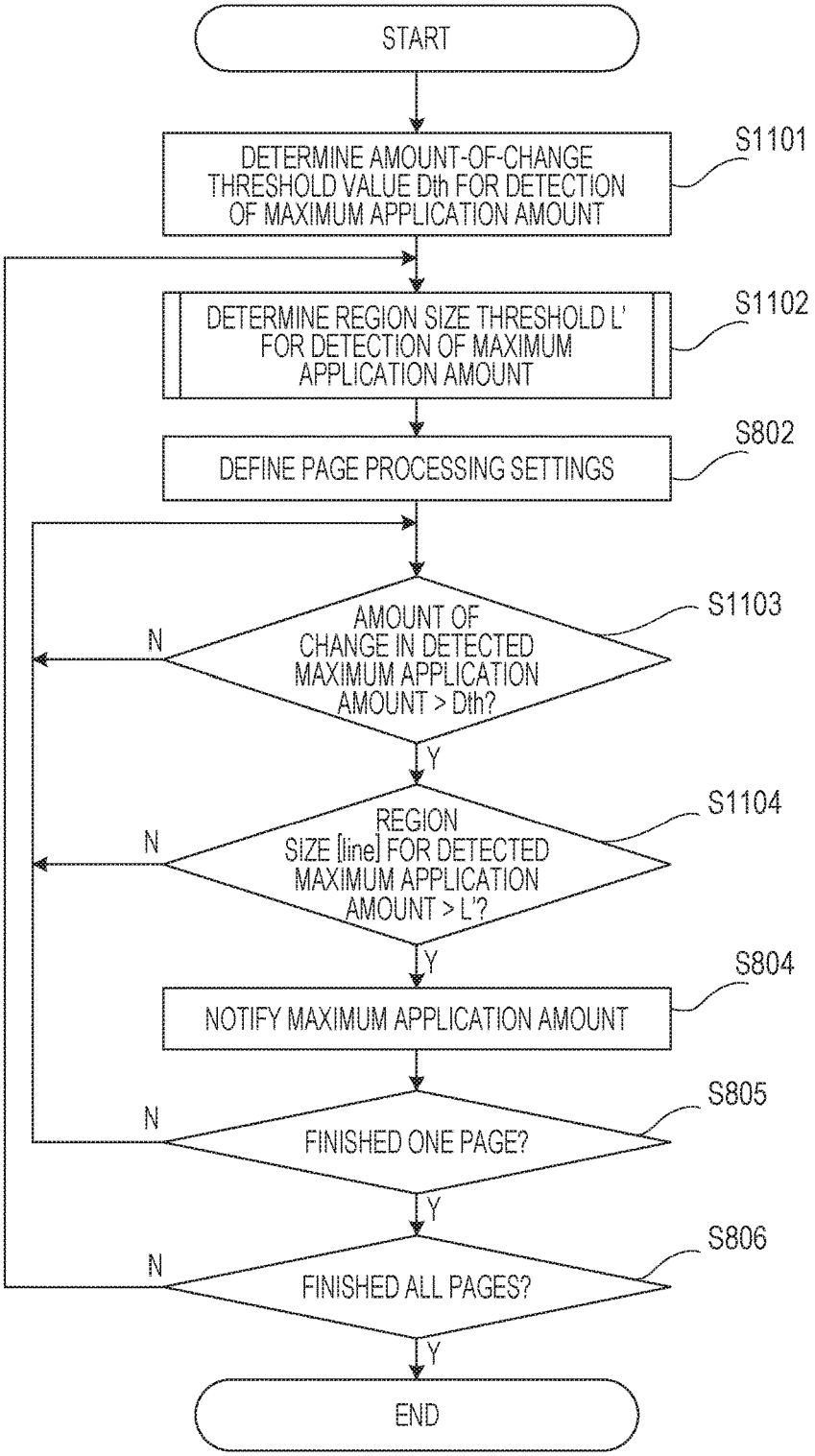
FIG. 11 is a flowchart illustrating a control method for the image forming apparatus.

FIG. 11 is a flowchart illustrating a control method for the image forming apparatus according to this embodiment. FIG. 11 illustrates an example of processing for detecting a maximum toner application amount and an example of processing for notifying the maximum toner application amount. Each step (hereinafter, S) is to be performed after the CPU 204 decompresses a program stored in the ROM 205 in the system controller unit 201 onto the RAM 206. The processing in S802, S804, S805, and S806 is performed as illustrated in FIG. 8. In the following example, whether an amount of change in toner application amount between a temperature adjustment region which is being detected and an adjacent temperature adjustment region which has already been detected is higher than a first threshold value or not is determined, and, if the amount of change in toner application amount is not higher than the first threshold value (threshold value Dth), the CPU 215 controls the fixing temperature of the fixing unit 31 such that the temperature adjustment region in contact with which has already been detected can keep the adjusted fixing temperature.

In S1101, the CPU 204 determines a threshold value Dth for the amount of change in toner application amount in the maximum toner application amount detection processing. Here, the threshold value Dth for the amount of change corresponds to a threshold value for the amount of change between a maximum toner application amount calculated in the region which is being processed and a maximum toner application amount in a previous region in the toner application amount detection processing for each region. Based on the threshold value Dth for the amount of change, unnecessary fixing temperature control can be inhibited if there is not an amount of change in toner application amount equal to or higher than a certain amount.

In order to provide a significant effect resulting from the fixing temperature control, the threshold value Dth for the amount of change is determined based on the relationship between the fixing temperature and the toner application amount illustrated in FIG. 4 and an effective temperature control width for the fixing unit 31.

In S1102, the CPU 204 determines a region size threshold value [L'] for detecting a maximum toner application amount. The region size threshold value [L'] may be determined by the method as illustrated in FIG. 10.

In S1103, the CPU 204 determines whether the toner application amount maximum value detected in the region which is currently being processed has changed by the amount of change threshold value Dth or larger from the toner application amount maximum value for the previous region. The CPU 204 can determine whether there is a change equal to or higher than the threshold value by waiting for notification by interrupt of a result of the threshold value comparison performed by the toner application amount detecting unit 210. Alternatively, the CPU 204 may sequentially read out detection results, which are updated in real time from the toner application amount detecting unit 210 and compare it with a threshold value to determine whether there is a change equal to or higher than the threshold value.

Because there is no previous detection result from the first region in the beginning of a print job, a maximum (such as 200%) is stored in the memory as a previous detection result inconsideration of safety against fixing failure. The held detection results may be updated by updating previous detection results held in the memory when fixing temperature control is actually performed in S804.

In S1104, the CPU 204 determines, for the region which is currently being processed, whether the region size used for toner application amount detection reaches the region size threshold value [L'] or not. The determination regarding the region size for toner application amount detection may be performed as illustrated in FIG. 8.

In the processing illustrated in FIG. 11, two of the threshold value Dth and the threshold value L' for the amount of change and the region size, respectively, are used so that the region size for detecting a toner application amount can dynamically be changed.

Thus, in a case where there are frequent changes in toner application amount in the sub-scanning direction of a medium, a sufficient time for the fixing temperature control can certainly be provided before the medium enters to the fixing unit and, at the same time, fixing temperature control can be performed in detail region units with high accuracy.

By performing the processing illustrated in FIG. 11, in a case where it is determined that the amount of change in toner application amount between a temperature adjustment region which is being detected and an adjacent temperature adjustment region which has already been detected is not higher than the first threshold value, the CPU 215 can control the fixing temperature of the fixing unit 31 to keep the fixing temperature adjusted in the adjacent temperature adjustment region which has already been detected. This can eliminate the necessity for execution of unnecessary temperature adjustment control, from which a power saving effect can be expected.

The control method according to this embodiment is not limited to the case where two of the threshold value Dth and the threshold value L' are used simultaneously, but any one of the threshold values may be used. For example, in a case where information that the region size lower limit value $L_{min}$ illustrated in FIG. 9 is sufficiently low is given in advance, the fixing temperature control can certainly be in time for entry of a medium to the fixing unit 31.

Therefore, the processing for comparison with the region size threshold value in S1104 in FIG. 11 can be omitted in this case.

Alternatively, S1103 and S1104 can be interchanged in FIG. 11. In other words, the region size threshold value comparison in S1104 may be performed first, and the threshold value comparison for the amount of change in toner application amount maximum value from that of the previous region. If the amount of change is lower than the threshold value Dth, the fixing temperature control for the region may be omitted, and the toner application amount detection processing is continuously performed on the region and the next region.

In other words, a reference for region sizes may be determined as [L'] in advance, and, if there is a small difference between regions, the region size for detection of a toner application amount can be dynamically increased by an integral multiple such as two or three times of [L'].

According to this embodiment, the division region size is variable so that fixing temperature control based on a toner application amount can be performed with high accuracy while suppressing ON/OFF control over the fixing unit 31.

According to the first and second embodiments, in a case where the fixing temperature of the fixing unit 31 has a larger variation width than normal, it may be controlled such that temperature adjustment may be started on the next region before the next region is processed in consideration of the temperature increase rate of the fixing unit 31, the calculated maximum toner application amount, and the time period for obtaining a target temperature increase.

This can prevent a rapid change of the fixing temperature from the fixing temperature of the previous region can reduce uneven image quality.

Modes for detecting two maximum toner application amounts may be provided including a first mode (high accuracy mode) for detecting a toner application amount maximum value for each division region and a second mode (safe mode) for detecting a toner application amount maximum value from a page beginning position to the current region to control such that the mode can be changed to adapt to an image processing state.

Thus, in a case where a state that a maximum toner application amount cannot be calculated may possibly occur in the high accuracy mode, the safe mode may be selected so that the fixing temperature control for adjusting the fixing temperature between regions can be realized.

Third Embodiment

According to the aforementioned embodiments, in a case where the CPU 215 determines that an increase width for the fixing temperature of the fixing unit 31 is larger than a third threshold value based on the temperature increase rate of the fixing unit 31 and the maximum toner application amount in a temperature adjustment region to be detected, it can be controlled such that the temperature adjustment control for the fixing unit 31 can be started even if it is determined that the total value of the division regions is not higher than a second threshold value.

This can avoid rapid increases and decreases of the fixing temperature and can reduce uneven image quality of a toner image transferred to a sheet.

The CPU 215 may be configured to have a first detection mode (individual mode) for detecting a toner application amount based on determined sizes of temperature adjustment regions and temperature adjustment regions of a sheet and a second detection mode (total mode) for detecting a toner application amount maximum value detected from a temperature adjustment region at a page beginning position of the sheet and may be configured to detect a toner application amount of each of the temperature adjustment regions in the first detection mode or the second detection mode selected based on the determined size of the temperature adjustment region.

Thus, even in a case where there is a possibility that a toner application amount cannot be detected due to the processing load on the CPU 215, control may be performed for inhibiting electric power load variations due to the temperature adjustment control and, at the same time, for forming an image with stable image quality.

The CPU 215 may increase the fixing temperature of the fixing unit 31 to a default fixing temperature (such as 200° C.) before start of image formation. The default fixing temperature here corresponds to the fixing temperature based on the maximum toner application amount.

Other Embodiments

Embodiment(s) of the disclosure can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)), a flash memory device, a memory card, and the like.

While the disclosure has been described with reference to exemplary embodiments, it is to be understood that the disclosure is not limited to the disclosed exemplary embodiments. The scope of the following claims is to be accorded the broadest interpretation so as to encompass all such modifications and equivalent structures and functions.

This application claims the benefit of Japanese Patent Application No. 2016-173376 filed Sep. 6, 2016, which is hereby incorporated by reference herein in its entirety.

What is claimed is:

1. An image forming apparatus, comprising:

a photoconductor;

an exposing unit configured to expose the photoconductor for forming a latent image on the photoconductor based on image data;

a developing unit configured to develop, by using toner, the latent image;

a transferring unit configured to transfer the image to a sheet;

a fixing unit configured to fix toner image transferred onto the sheet; and a control unit configured to divide the image data into a plurality of regions in a sub-scanning direction based on an attribute of the sheet, determine a target temperature for each region from a result of analyzing the region, and control a temperature of the fixing unit based on the determined target temperature.

2. The image forming apparatus according to claim 1, wherein the control unit divides the image data into the plurality of regions in a sub-scanning direction based on a process speed of the image forming apparatus.

3. The image forming apparatus according to claim 1, wherein the control unit divides the image data into the plurality of regions in a sub-scanning direction based on a distance from the photoconductor to a nip position of the fixing unit.

4. The image forming apparatus according to claim 1, wherein the control unit divides the image data into the plurality of regions in a sub-scanning direction based on a temperature increase rate of the fixing unit.

5. The image forming apparatus according to claim 1, wherein the attribute of the sheet includes a length of the sheet associated with the sub-scanning direction for conveyance and types of the sheet.

6. The image forming apparatus according to claim 5, wherein the types of sheet include thick paper, plain paper, and thin paper.

7. The image forming apparatus according to claim 1, wherein the control unit completes adjustment of the temperature of the fixing unit before a leading end of each of the regions on the conveyed sheet reaches the nip position of the fixing unit.

8. The image forming apparatus according to claim 1, wherein the control unit changes a target fixing temperature for the fixing unit in a case where the amount of change in toner application amount between adjacent divided regions is the same or lower than a first threshold value.

9. The image forming apparatus according to claim 1, wherein the control unit changes a target fixing temperature for the fixing unit in a case where the amount of change in toner application amount is the same or lower than a first threshold value and a total value of the amounts of change of the divided regions are the same or lower than a second threshold value.

10. The image forming apparatus according to claim 9, wherein the second threshold value is a lower limit value for divided regions.

11. The image forming apparatus according to claim 9, wherein the control unit starts temperature adjustment control over the fixing unit in a case where an increase amount of the fixing temperature of the fixing unit is larger than a third threshold value and in a case where the total value of the divided regions is not higher than the second threshold value.

12. The image forming apparatus according to claim 1, wherein the control unit increases the fixing temperature of the fixing unit to a default fixing temperature before image formation is started.

13. The image forming apparatus according to claim 12, wherein the default fixing temperature is a fixing temperature for a maximum toner application amount.

14. The image forming apparatus according to claim 1, wherein the developing unit includes developing units configured to develop latent images formed on photoconductors for different colors by using toners of different colors and disposed at predetermined intervals in a conveying direction of the sheet.

* * * * *